United States Patent [19]

Wandroik

[11] Patent Number: 4,584,042

[45] Date of Patent: Apr. 22, 1986

[54] ARTISTIC METHOD AND KIT FOR CREATING AN ART FORM

[76] Inventor: Walter J. Wandroik, 8549 Ferald, Morton Grove, Ill. 60053

[21] Appl. No.: 669,613

[22] Filed: Nov. 8, 1984

[51] Int. Cl.[4] ..... B05D 5/06; B65D 69/00

[52] U.S. Cl. ..... 156/280; 206/575; 427/11; 427/258; 427/265; 427/288; 434/84; 156/62

[58] Field of Search ..... 434/84; 427/11, 258, 427/265, 288; 206/575; 156/280, 62

[56] References Cited

U.S. PATENT DOCUMENTS

| | | | |
|---|---|---|---|
| 2,065,266 | 12/1936 | Connelly | 427/11 |
| 2,811,800 | 11/1957 | Gesek | 427/11 X |
| 3,093,462 | 6/1963 | Rapaport | 434/84 X |
| 3,588,260 | 6/1971 | Caywood et al. | 434/84 X |
| 3,744,152 | 7/1973 | Crasilneck | 427/265 X |
| 3,802,904 | 4/1974 | Morrison | 427/282 |
| 4,279,674 | 7/1981 | Wadden | 427/260 X |

OTHER PUBLICATIONS

"Melt 'N Color TM", product description in *Milton Bradley Arts & Activities* 1965, Springfield, Massachusetts, Milton Bradley Company, 1965, p. 11.

*Primary Examiner*—Evan K. Lawrence
*Attorney, Agent, or Firm*—Thomas R. Vigil

[57] ABSTRACT

The artistic method for creating an art form includes the step of permanently affixing a first substrate material to a second substrate material wherein the second substrate material is rigid relative to the first substrate material. A heat-activated transitional material is then softened with a flame and applied to an upper surface of the first substrate material wherein the transitional material has a predetermined color and is applied to the upper surface of the first substrate material with varying amounts of pressure so that the softened transitional material adheres to the upper surface of the first substrate material and solidifies thereon to a predetermined thickness and has a desired predetermined texture. The artistic method for creating an art form can further include the step of coating the solidified transitional material on the upper surface of the first substrate material with a protective material. A kit is provided for carrying out the method and includes substrate materials, crayons, and a candle.

47 Claims, 10 Drawing Figures

ARTISTIC METHOD AND KIT FOR CREATING AN ART FORM

BACKGROUND OF THE INVENTION

1. Field of the Invention

The present invention relates to an artistic method and kit for creating an art form having a textured surface and which appears to be three-dimensional. The method of creating the art form includes the step of heating a heat-activated transitional material, which is caused to go through a phase transition from liquid to solid when subjected to heat, until the transitional material melts or becomes softened, and applying the softened transitional material to an absorbent material with varying amounts of pressure so that the transitional material applied thereto solidifies to a desired thickness and texture so that the art form created thereon is three-dimensional in appearance.

2. Description of the Prior Art

Heretofore, various artistic methods for creating an art form have been proposed. Examples of such previously proposed artistic methods are disclosed in the following U.S. Pat. Nos.:

| U.S. PAT. NO | PATENTEE |
|---|---|
| 2,065,266 | Connelly |
| 2,811,800 | Gesek |
| 3,093,462 | Rapaport |
| 3,588,260 | Caywood |
| 3,744,152 | Crasilneck |
| 3,802,904 | Morrison |
| 4,279,674 | Wadden |

The Connelly U.S. Pat. No. 2,065,266 discloses a method of painting which includes the step of first creating a picture with water color paints, and then applying like-colored crayon materials directly over areas of like-colors of water colors in a picture, and then rubbing the crayon surface to polish the crayon materials as well as blend the colors.

The Gesek U.S. Pat. No. 2,811,800 discloses a method of making a translucent graphic representation which simulates a stained glass window, and which includes the step of first drawing an outline of the representation on a sheet of absorbent material capable of impregnation by wax. The wax is applied to the absorbent material by either rubbing a candle or sprinkling wax flakes onto the absorbent material and then the absorbent material positioned on a hot plate so that the wax applied thereto melts. Outlined portions of the sheet of absorbent material are then colored with wax crayons so that the crayons melt and flow along the surface of the sheet in order to blend with colors in adjacent portions of the sheet.

The Rapaport U.S. Pat. No. 3,093,462 discloses a process of decorating a painting which includes the step of first outlining the picture on a plaque with a water soluble adhesive which is dissolved with water and a color granulated material, such as wax, is then sprinkled thereon.

The Caywood U.S. Pat. No. 3,588,260 discloses a marker and an abrasive surface which is sharp enough to abrade the marker. The surface is filled with a wax which will cause the pigment which is abraded by the sharp surface to be compounded therein as crayon color marking.

The Crasilneck U.S. Pat. No. 3,744,152 discloses a method of creating bas-relief and mezzo-relievo art works wherein the subject to be portrayed is detailed or outlined on a suitable material. The subject to be portrayed is completed by applying selective applications of a transparent or translucent drying glue to the material until the desired buildup of each portion of the subject is attained. When the desired relief has been obtained, paint or other media is applied to the art work.

The Morrison U.S. Pat. No. 3,802,904 discloses a method of making a decorative article which includes a guide sheet adapted to be laid over a surface to be decorated. A transfer sheet is rubbed with a writing instrument, such as a wax base crayon, and the crayon bearing surface of the transfer sheet is placed in opposition to a surface to be decorated. Pressure is applied to the opposed surfaces by rubbing the opposed surfaces in order to transfer the crayon material on the transfer sheet to the surface to be decorated.

The Wadden U.S. Pat. No. 4,279,674 discloses a process for preparing works of art which includes the steps of melting a crayon onto a hot plate by touching the surface of the hot plate with a crayon until the crayon melts so that the liquid mass of crayon remains thereon. A sheet of paper is then drawn through the mass of crayon in order to produce a smooth and even background with the crayon onto the paper. The paper, together with the melted crayon, is then removed from the hot plate and cooled, and a hand held tool, such as a hot iron, is then used to etch a picture into the crayon surface.

As will be described in greater detail hereinafter, the artistic method of the present invention for creating an art form differs from the various artistic methods previously proposed by including the steps of melting or softening a heat-activated transitional material and then applying the softened transitional material to an absorbent material, such as a sheet of construction paper, to a desired thickness in order to create an art form having a textured surface which appears to be three-dimensional. By applying the transitional material to the absorbent material when the transitional material is softened, the transitional material solidifies on the absorbent material to a predetermined and desired thickness. In this manner, the thickness of the transitional material being applied to the absorbent material can be controlled so that a particular object, such as a tree, can be three-dimensionally illustrated by the thickness and texture of the solidified transitional material applied to the absorbent material.

SUMMARY OF THE INVENTION

According to the invention, there is provided an art and craft kit for creating an art form having a three-dimensional appearance, said kit comprising: a first substrate material, said first substrate material having an upper surface and a lower surface, said upper surface including instructive means for creating an art form on said upper surface of said first substrate material; a second substrate material, said second substrate material having dimensions approximately equal to said first substrate material and being rigid relative to said first substrate material; said first substrate material being adapted to be affixed or being affixed to said second substrate material; solid heat-activated transitional material for creating an art form having a three-dimensional texture on said upper surface of said first substrate material; said transitional material being capable of being softened for creating said art form and being adapted to adhere to said upper surface of said first substrate material; and a candle which can be lighted to create a flame for heating said transitional material for softening same to create said art form on said upper surface of said first substrate material, said transitional material being capable of being heated with a flame of said candle to a temperature sufficient to soften said transitional material so that said transitional material can be transferred to said upper surface of said first substrate material and then solidified thereon to create the art form.

Still further, the kit can include a material for protecting the art form created by the heat-activated transitional material after the heat-activated transitional material has been applied thereto.

Further, according to the invention, there is provided an artistic method for creating an art form, said method including the steps of: permanently affixing a first substrate material to a second substrate material, said second substrate material being rigid relative to said first substrate material; heating with a flame a heat-activated transitional material to soften same; and applying said softened transitional material to an upper surface of said first substrate material, said transitional material having a predetermined color and being applied to said upper surface of said first substrate material with varying amounts of pressure and to a desired thickness, said softened transitional material adhering to said upper surface of said first substrate material and solidifying thereon to a predetermined thickness and thereby forming a desired predetermined texture thereon.

DESCRIPTION OF THE PREFERRED EMBODIMENT

Figure 1:
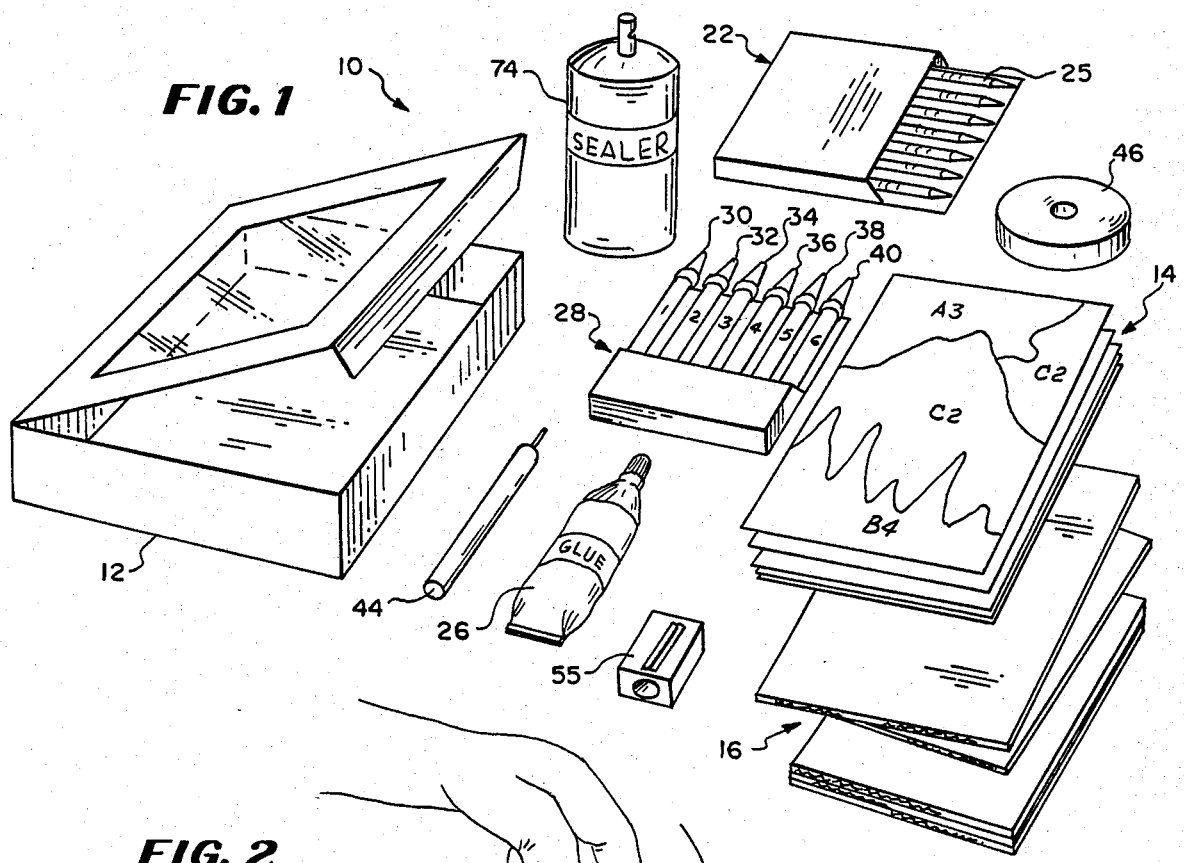
FIG. 1 is a composite perspective view of the kit of the present invention including the heat-activated transitional material and additional items helpful in carrying out the method of the present invention.

Referring to FIG. 1, there is illustrated therein an art and craft kit 10 for creating an art form according to the method of the present invention. As will be described in greater detail hereinafter, the kit 10 includes the necessary materials for creating the art form and such materials are contained or stored within a box or carrying case 12.

The kit 10 includes a plurality of sheets of a first substrate material 14, and a plurality of sheets of a second substrate material 16 equal in number to and having the same dimensions as the sheets of the first substrate material 14. The first substrate material from which the sheets 14 are made of is a paper material that is absorbent, preferably construction paper, and has dimensions of approximately 8"×10". Additional sheets 14 having other appropriate or suitable dimensions may also be included in the kit 10.

Figure 2:
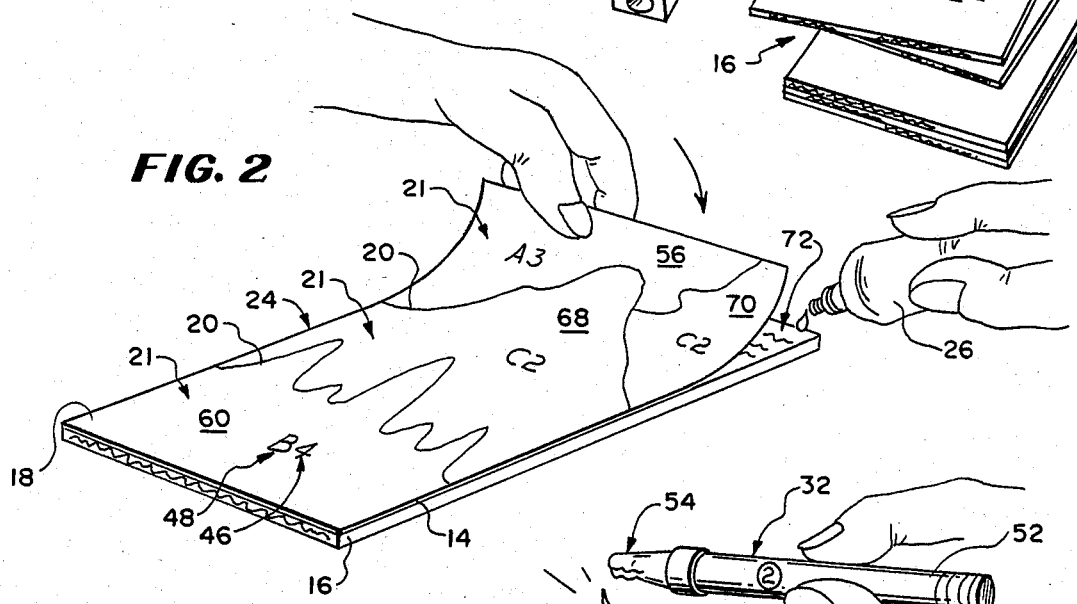
FIG. 2 is a perspective view of the substrate materials and shows one method of gluing a sheet of a first substrate material to a sheet of a second substrate material.

It is to be appreciated that according to the teachings of the method of the present invention and as further illustrated in FIG. 2, an upper surface 18 of each of the sheets of construction paper 14 has preprinted delineations 20 which form delineated areas 21 therebetween. These areas form a predetermined picture or illustration 24 to be completed on the upper surface 18 of each of the sheets of construction paper 14. The preprinted delineations 20 are preprinted on the upper surface 18 of the sheets of construction paper 14 with a color which is preferably lighter than the particular sheet of construction paper 14 upon which the delineations 20 have been preprinted.

In this respect, the sheets of construction paper 14 which are included in the kit 10 can be of different colors, depending upon the predetermined picture to be completed on the upper surface 18 of a particular sheet of construction paper 14. For example, and for purposes of illustration only, if the picture to be completed on an upper surface 18 of a sheet of construction paper 14 is a boat floating on a body of water, it is preferable that the sheet of construction paper be light blue in color, thereby representing the color of the water and the color of the sky thereon. The preprinted delineations 20 are then white in color. In this manner, the white, preprinted delineations 20 on the upper surface 18 of the sheet of construction paper 14 can be further highlighted with an appropriately colored felt tip marker or colored pencil 22 which are also provided in the kit 10. For example, the white preprinted delineations 20 can be further highlighted with a dark blue color pencil or felt tip marker 25 in order to further contrast the colors of the water and the sky.

The second substrate material from which the sheets 16 are made of is a material which is rigid relative to the sheets of construction paper 14 in order to reinforce or support a sheet of construction paper 14 when it is affixed to a sheet 16 of the second substrate material. Preferably, the second substrate material from which the sheets 16 are made is cardboard or canvas board, and have dimensions approximately equal to the sheets of construction paper 14 which are included in the kit 10.

The kit 10 further includes a tube or bottle 26 of an adhesive material, such as a glue, which is used to permanently affix a lower surface (not shown) of a sheet of construction paper 14 to a sheet of canvas board 16 having dimensions approximately equal to the dimensions of the sheet of construction paper 14. In this manner, once a sheet of construction paper 14 has been glued to a sheet of canvas board 16, the canvas board 16 reinforces the construction paper 14 in order to provide a hard or firm surface on which a picture 24 is created on the upper surface 18 of the construction paper 14 according to the method of the present invention, and as will be described in greater detail hereinafter. To simplify the kit, the tube 26 of adhesive can be omitted, and a set of first sheets with second sheets already affixed thereto can be provided in the kit.

After the picture or illustration 24 has been completed on the upper surface 18 of a sheet of construction paper 14 as will be described in greater detail hereinafter, the canvas board 16 further provides a mat or matting to the sheet of construction paper 14 in order to enable the sheet of construction paper 14 with the completed picture or illustration thereon to be framed.

According to the teachings of the present invention, the kit 10 further includes a heat-activated transitional material 28 which is used to complete a picture 24 on the upper surface 18 of the sheet of construction paper 14. The transitional material 28 is adapted to be softened or melted and then applied to the upper surface 18 of the construction paper 14. The transitional material 28 solidifies and adheres to the upper surface 18 of the construction paper 14 to a predetermined thickness and texture.

The transitional material 28 is preferably a colored paraffin wax material or marker, such as a crayon. Preferably, the kit 10 includes a plurality of colored wax markers 28, each being of different color and including a red wax marker 30, a white wax marker 32, a blue wax marker 34, a green wax marker 36, a yellow wax marker 38 and a black wax marker 40.

The wax markers 28 are applied to an upper surface 18 of a sheet of construction paper 14 by first softening a wax marker 28 with a heat source, such as the flame 42 of a candle 44 which can also be included in the kit 10. Preferably, the candle 44 is of a size sufficient to burn for an extended period of time in order to enable a user of the kit 10 to complete a picture or illustration according to the method of the present invention during one sitting. The kit 10 then includes a wide base 46 on which the candle 44 is mounted to prevent the candle 44 from tipping while in use.

Figure 4:
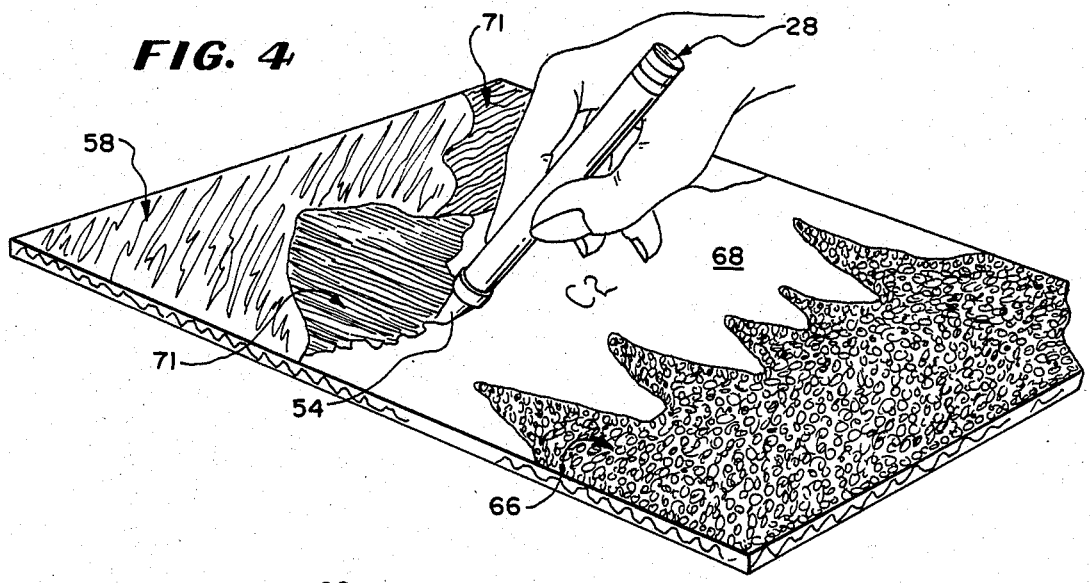
FIG. 4 is a perspective view of the substrate materials and the transitional material and shows the heated heat-activated transitional material shown in FIG. 3 being applied to the upper surface of the first substrate material.

Referring now to FIGS. 2 and 4, it is to be appreciated that according to the teachings of the present invention and method, the upper surface 18 of each of the sheets of construction paper 14 include preprinted color-coded indicia 46 and preprinted texture-coded indicia 48 within each of the delineated areas 21 formed by the preprinted delineations 20. As will be described in greater detail hereinafter, the color-coded indicia 46 and the texture-coded indicia 48 enable a user of the kit 10 to complete a picture on the upper surface 18 of the sheet of construction paper 14 by indicating to a user which color of a wax marker 28 to use and the type of stroke to be used in applying a softened marker 28 to the upper surface 18 of the construction paper 14. The indicia 48 can also indicate a desired predetermined thickness and texture of the material to be placed on the upper surface 18.

Figure 6:
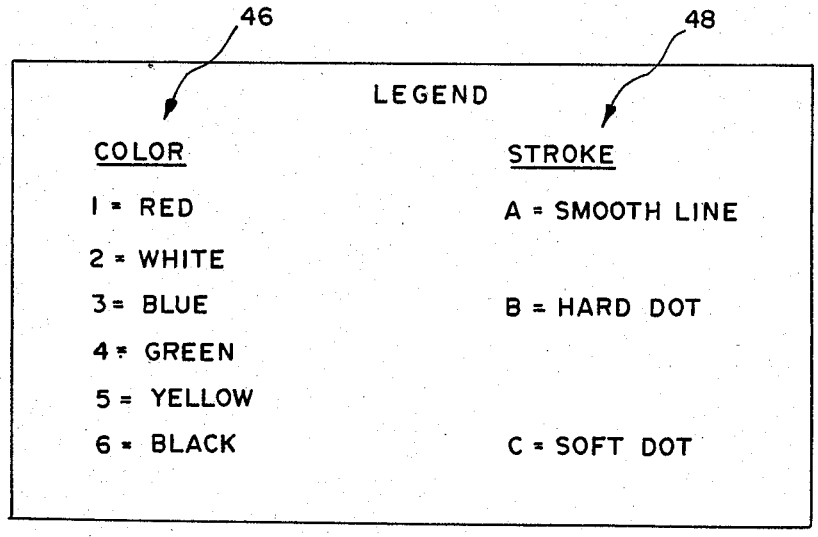
FIG. 6 is a plan view of a legend which is included in the kit of the present invention.

In order to enable the user of the kit 10 to complete a picture or illustration according to the color-coded indicia 46 and the texture-coded indicia 48 preprinted with the delineated areas 21 formed by the preprinted delineations 20 on the upper surface 18 of the sheet of construction paper 14, the kit 10 further includes a legend 50 (FIG. 6) which correlates the preprinted color-coded indicia 46 and the printed texture-coded indicia 48 with the corresponding colors and textures of the wax markers 28 to be applied to a particular delineated area 21 on the upper surface 18 of the sheet of construction paper 14. In this respect, each of the wax markers 28 can have a paper sheath or wrapper 52 having a corresponding numerical color-coded indicia 46 printed thereon which identifies a particular color of wax marker 28 according to the legend 50. For example, the paper sheath 52 of the red wax marker 30 can have the number "1" preprinted thereon, corresponding to the number "1" on the legend 50 which identifies the red wax marker 30. In this manner, when the number "1" appears within a particular delineated area 21 of the picture to be completed 24 on the upper surface 18 of the sheet of construction paper 14, the user of the kit 10 identifies the number "1" within the particular delineated area 21 with the number "1" on the sheath 52 of the red marker 30 and applies the softened red wax marker 30 to that particular delineated area 21.

In addition to having the identifying and corresponding color-coded numerical indicia 46 for the particular colors of the wax markers 28, the legend 50 further includes the texture-coded indicia 48 for identifying the particular type of stroke to be used when applying a softened wax marker 28 to the upper surface 18 of the sheet of construction paper 14. In this respect, the legend 50 identifies the three basic strokes which are used in applying a softened wax marker 28 to the upper surface 18 of a sheet of construction paper 14 in order to create a desired texture, although other strokes in addition to the three basic strokes may also be used by one who has mastered, or is experienced in, the method of the present invention.

Figure 3:
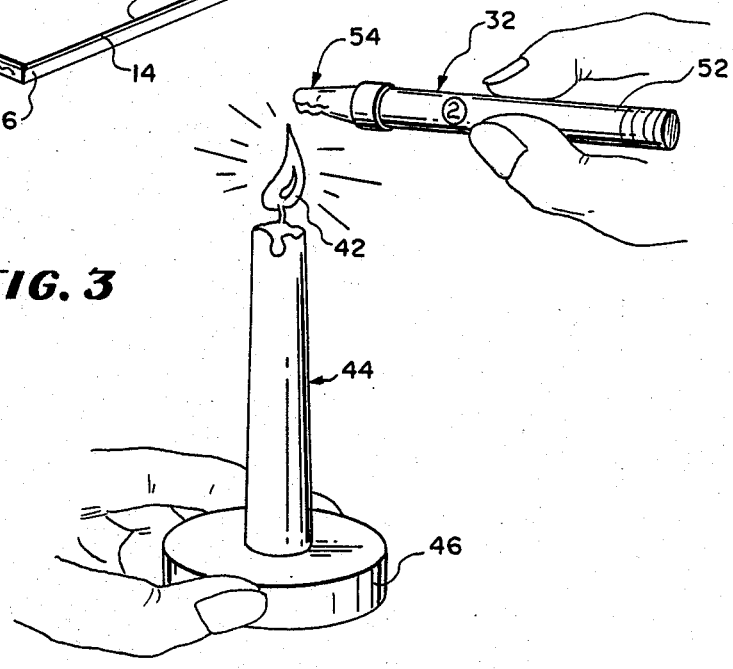
FIG. 3 is a perspective view of the substrate materials and shows the heat-activated transitional material being heated with the flame of a candle.

Referring to FIG. 3, before applying a wax marker 28 to the upper surface 18 of a sheet of construction paper 14 according to the teachings of the present invention, the distal end 54 of a wax marker 28 is held within the flame 42 of the candle 44 for a time sufficient to soften the marker. In this manner, the wax marker 28 is softened so that the paraffin material from which the wax marker 28 is made of can be applied to a delineated area 21 of the upper surface 18 of the sheet of construction paper 14 with the appropriate stroke and to a desired thickness and texture. Since the repeated heating and application of the wax markers 28 will tend to eliminate the pointed distal ends 54 of the wax markers 28, a sharpener 55 can be provided in the kit 10 for sharpening the wax markers 28. Preferably, three wax markers of each color are included in the kit so that while one used marker is cooling prior to the resharpening, one can continue with another marker.

Figure 5A:
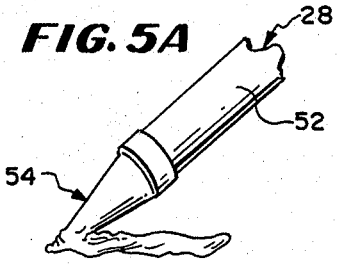
FIG. 5A is a perspective view of the heat-activated transitional material and shows one method for applying the heated heat-activated transitional material to the upper surface of the first substrate material.

Referring to FIG. 5A, a first stroke, generally identified, for example, by the letter "A" in the legend 50, is used when it is desirable to illustrate a smooth surface, such as a road, a wall, or the sky. The appearance of a smooth surface when using this stroke is accomplished by softening the distal end 54 of a wax marker 28 and bringing the softened distal end 54 of the wax marker 28 in direct contact with the appropriate delineated area 56 (FIG. 2) on the upper surface 18 of the construction paper 14. Once the softened distal end 54 of the wax marker 28 has come into direct contact with the upper surface 18 of the construction paper 14, the wax marker 28 is drawn across the upper surface 18 with a long, even-pressured stroke until the softened paraffin material of the wax marker 28 is no longer available. The distal end 54 of the wax marker 28 is again held in the flame 42 of the candle 44 and the steps as heretofore described repeated until the delineated areas 56 calling for stroke "A" has been completely covered with the paraffin material of the wax marker 28. The delineated area 56 in FIG. 2, identified with the color-coded indicia 46 by the numeral "3" and identified with the texture-coded indicia 48 by the letter "A", can call for the blue wax marker 34 to be applied to the area 56 by using stroke "A" as heretofore described in order to complete the color and texture of the sky 58 as further illustrated in the partially completed picture shown in FIG. 4.

Figure 5B:
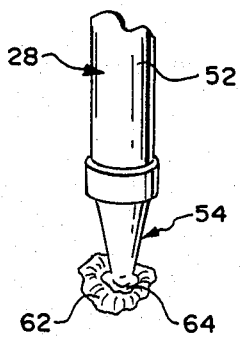
FIG. 5B is a perspective view of the heat-activated transitional material and shows another method for applying the heated heat-activated transitional material to the upper surface of the first substrate material.

Referring to FIG. 5B, a second stroke, generally identified, for example, by the letter "B" in the legend 50, is used when it is desirable to provide a contrasting or mottled appearance between the particular wax marker 28 being used and the color of the construction paper 14, such as for illustrating the leaves of a tree. The appearance of a mottled texture when using this stroke is accomplished by bringing the softened distal end 54 of the wax marker 28 in direct contact with the appropriate delineated area 60 (FIG. 2) of the upper surface 18 of the construction paper 14 in the manner as heretofore described in a heavy-pressured, dot-like manner while holding the wax marker 28 at approximately a 90 degree angle relative to the upper surface 18 of the construction paper 14. In this manner, the stroke "B" provides a circular buildup or mound 62 of paraffin material having a central area 64 with little or no paraffin material therebetween, thereby providing a contrast in colors between the color of the wax marker 28 applied to the upper surface 18 of the construction paper 14 with stroke "B" and the particular color of the construction paper 14. The delineated area 60 in FIG. 2, identified with the color-coded indicia 46 by the numeral "4" and identified with the texture-coded indicia 48 by the letter "B", can call for the green wax marker 36 to be applied to the area 60 by using stroke "B", as heretofore described, to complete the color and texture of the trees 66 as further illustrated in the partially completed picture shown in FIG. 4. In this respect, it is to be appreciated that according to the teachings of the present invention and method, the sheets of construction paper 14 provided in the kit 10 can be of different colors so that the color of the mound 62 of the paraffin material of a wax marker 28 can be contrasted with the color of the construction paper 14 which appears within the central area 64 when applying a wax marker 28 using stroke "B".

Figure 5C:
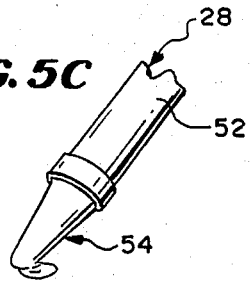
FIG. 5C is a perspective view of the heat-activated transitional material and shows still another method for applying the heated heat-activated transitional material to the upper surface of the first substrate material.

Referring to FIG. 5C, a third stroke, generally identified, for example, by the letter "C" in the legend 50, is used when it is desirable to provide an appearance of depth to the picture being completed, such as for illustrating water, grass, clouds, or snow. In order to give the appearance of depth when using this stroke, the softened distal end 54 of a wax marker 28 is brought into direct contact with the appropriate delineated area 68, 70 (FIG. 2) of the upper surface 18 of the construction paper 14 in the manner as heretofore described and applied thereto in a gentle or soft-pressured dot-like manner while holding the wax marker 28 at approximately a 45 degree angle relative to the upper surface 18 of the construction paper 14. In this manner, stroke "C" enables the paraffin material of the wax marker 28 to be applied in varying degrees of thicknesses in order to give the particular delineated area 68, 70 being completed a three-dimensional appearance. The delineated areas 68, 70 in FIG. 2, identified with the color-coded indicia 46 by the numeral "2" and identified with the texture-coded indicia 48 by the letter "C", can call for the white wax marker 32 to be applied to the area 68, 70 using stroke "C", as heretofore described, to complete the color and texture of the snow 71 as further illustrated in the partially completed picture shown in FIG. 4.

Referring again to FIG. 2, the method of the present invention is carried out by first applying a thin coat of the adhesive material 26 provided to the kit 10 to a surface 72 of a sheet of canvas board 16. A sheet of construction paper 14 is then positioned on the surface 72 of the canvas board 16 with an even amount of pressure in order to secure the construction paper 14 to the canvas board 16.

Next, once the user of the kit 10 has determined the colors of the wax markers 28 to be used in order to complete the picture 24 according to the preprinted color-coded indicia 46 within the delineated areas 21 on the upper surface 18 of the construction paper 14, the user then high-lights (not shown) the delineations 20 with the appropriately colored felt tip marker or colored pencil 22 as heretofore described.

After the preprinted delineations 20 have been highlighted with the appropriate felt tip markers or colored pencils 22, the user of the kit 10 then applies the appropriate wax markers 28 to the delineated areas 21 on the upper surface 18 of the construction paper 14 by matching the corresponding preprinted color-coded indicia 46 within the delineated areas 21 with the corresponding numbered wax marker 28, and applying the softened wax marker 28 to the delineated area 21 with the appropriate stroke identified by the texture-coded indicia 48 within the delineated areas 21 as heretofore described.

Finally, once the picture or illustration 24 has been completed on the upper surface 18 of the construction paper 14 according to the color-coded indicia 46 and the texture-coded indicia 48, the picture 24 formed by the solidified paraffin material from the wax markers 28 is then coated with a protective material 74, such as an acrylic spray, which is further provided to the kit 10.

It is to be appreciated that according to the teachings of the present invention, the kit 10 and method are not limited to the completion of a predetermined picture or illustration which has been formed on the upper surface 18 of a sheet of construction paper 14 by the preprinted delineations 20. In this respect, the kit 10 may further include additional sheets of construction paper 14 which do not have preprinted delineations 20 or color-coded indicia 46 or texture-coded indicia 48 thereon. This enables a user of the kit 10 to create his or her own design or illustration on a sheet of construction paper 14 by applying the desired color and texture of the wax markers 28 of his or her own choice.

Figure 7:
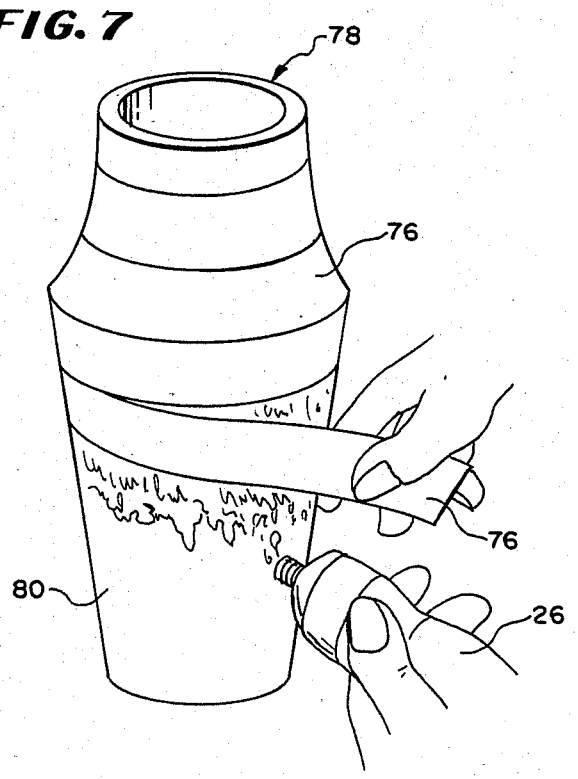
FIG. 7 is a perspective view of a three-dimensional substrate assembly and shows another method of gluing a first substrate material to a second substrate material.
Figure 8:
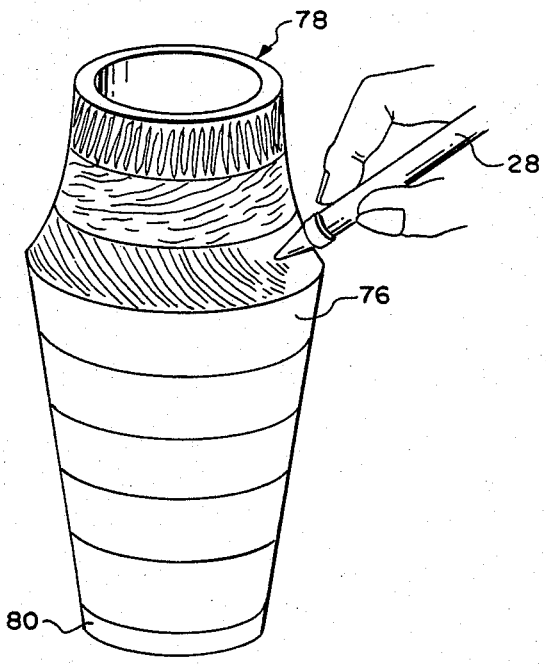
FIG. 8 is a perspective view similar to the view shown in FIG. 7 and shows the heated heat-activated transitional material being applied to the upper surface of the first substrate material.

Referring now to FIGS. 7 and 8, it is also to be appreciated that according to the teachings of the present invention, the kit 10 and method are not limited to completing a picture or design on a flat, planar sheet of construction paper 14 as heretofore described. In this respect, a sheet of construction paper can be cut into strips 76 and permanently affixed to a three-dimensional structure 78, such as a vase, with the adhesive material 26 (FIG. 7). Once the strips of construction paper 76 have been glued to the vase 78, the wax markers 28 can be applied to the strips of construction paper 76 as heretofore described in order to give the outer surface 80 of the vase 78 a textured or three-dimensional appearance, as well as to provide a desired color or colors to the surface 80 of the vase 78 in an artistic manner with the wax markers 28.

Again the completed three-dimensional art form then can be coated with a protective material such as varnish, shellac or acrylic material.

From the foregoing description, it will be apparent that the kit 10 and method for using same have a number of advantages, some of which have been described above and others of which are inherent in the invention. Also, it will be apparent that modifications can be made to the kit 10 and to the method of creating the art form without departing from the teachings of the present invention. Accordingly, the scope of the invention is only to be limited as necessitated by the accompanying claims.

I claim:

1. An artistic method for creating an art form, said method including the steps of: permanently affixing a first substrate material to a second substrate material, said second substrate material being rigid relative to said first substrate material; heating with a flame a heat-activated transitional material to soften same; applying said softened transitional material to an upper surface of said first substrate material and allowing said softened transitional material to solidify, said transistional material having a predetermined color and being applied to said upper surface of said first substrate material with varying amounts of pressure, so that said softened transitional material adheres to said upper surface of said first substrate material and solidifies thereon to a desired thickness and texture, thereby creating an art form having a three-dimensional appearance.

2. The method of claim 1 including the step of coating said solidified transitional material on said upper surface of said first substrate material with a protective material.

3. The method of claim 1 wherein said softened transitional material is applied to said first substrate material in a dot-like manner.

4. The method of claim 1 wherein said softened transitional material is applied to said first substrate material in a stroke-like manner.

5. The method of claim 1 wherein said heat-activated transitional material is a paraffin material.

6. The method of claim 5 wherein said paraffin material has a predetermined color.

7. The method of claim 1 wherein said first substrate material is permanently affixed to said second substrate material by gluing said first substrate material to said second substrate material.

8. The method of claim 1 wherein said first substrate material is generally planar and has dimensions approximately equal to said second substrate material.

9. The method of claim 8 wherein said first substrate material is a sheet of absorbent paper.

10. The method of claim 9 wherein said absorbent paper is construction paper.

11. The method of claim 1 wherein said second substrate material is cardboard.

12. The method of claim 1 wherein said second substrate material is canvas board.

13. The method of claim 8 wherein said planar first substrate material includes preprinted delineations which form delineated areas of a predetermined picture to be completed on said upper surface of said first substrate material

14. The method of claim 13 wherein said preprinted delineations are further high-lighted with a predetermined color.

15. The method of claim 8 wherein said planar first substrate material includes preprinted first and second kinds of instructive indicia within said preprinted delineated areas.

16. The method of claim 15 wherein said first kind of instructive indicia includes color-coded indicia for indicating a predetermined and corresponding coded color of said softened transitional material to be applied to a predetermined delineated area of said first substrate material.

17. The method of claim 15 wherein said second kind of instructive indicia includes texture-coded indicia for indicating a predetermined texture to be formed by said softened transitional material when said softened transitional material is applied to a predetermined delineated area of said first substrate material.

18. The method of claim 1 wherein said first substrate material includes a plurality of elongate strips of construction paper, said elongate strips of construction paper being glued to said second substrate material.

19. The method of claim 18 wherein said second substrate material is a three-dimensional structure.

20. The method of claim 2 wherein said protective material is an acrylic spray.

21. The method of claim 2 wherein said protective material is shellac.

22. An art and craft kit for creating an art form having a three-dimensional appearance, said kit comprising: a first substrate material, said first substrate material having an upper surface and a lower surface, said upper surface including instructive means for creating an art form on said upper surface of said first substrate material; a second substrate material, said second substrate material having dimensions approximately equal to said first substrate material and being rigid relative to said first substrate material; said first substrate material being adapted to be affixed or being affixed to said second substrate material; solid heat-activated transitional material for creating an art form having a three-dimensional texture on said upper surface of said first substrate material; said transitional material being capable of being softened for creating said art form and being adapted to adhere to said upper surface of said first substrate material; and a candle which can be lighted to create a flame for heating said transitional material for softening same to create said art form on said upper surface of said first substrate material, said transitional material being capable of being heated with a flame of said candle to a temperature sufficient to soften said transitional material so that said transitional material can be transferred to said upper surface of said first substrate material and then solidified thereon to create the art form.

23. The kit of claim 22 further including means for protecting said art form on said upper surface of said first substrate material.

24. The kit of claim 22 wherein said heat-activated transitional material is a paraffin material.

25. The kit of claim 24 wherein said paraffin material is colored.

26. The kit of claim 24 including a plurality of paraffin material markers of different colors.

27. The kit of claim 22 wherein said first substrate material is generally planar and being generally square in configuration.

28. The kit of claim 22 wherein said first substrate material is generally planar and being generally rectangular in configuration.

29. The kit of claim 22 wherein said means for permanently affixing said first substrate material to said second substrate material is glue.

30. The kit of claim 22 wherein said lower surface of said first substrate material is permanently affixed to a surface of said second substrate material.

31. The kit of claim 22 wherein said first substrate material is a sheet of absorbent paper.

32. The kit of claim 31 wherein said absorbent paper is construction paper.

33. The kit of claim 22 wherein said second substrate material is cardboard.

34. The kit of claim 22 wherein said second substrate material is canvas board.

35. The kit of claim 22 wherein said instructive means on said upper surface of said first substrate material includes preprinted delineations which form delineated areas of a predetermined picture to be completed on said upper surface of said first substrate material, and first and second kinds of instructive indicia preprinted within said delineated areas.

36. The kit of claim 35 further including a coloring material for further high-lighting said preprinted delineations.

37. The kit of claim 36 wherein said coloring material is a felt tip marker having a predetermined color.

38. The kit of claim 36 wherein said coloring material is a pencil having a predetermined color.

39. The kit of claim 35 wherein said first instructive indicia include color-coded indicia for indicating a predetermined and corresponding coded color of said softened transitional material to be applied to a predetermined delineated area of said first substrate material.

40. The kit of claim 35 wherein said second kind of instructive indicia includes texture-coded indicia for indicating a predetermined texture to be formed by said softened transitional material when said softened transitional material is applied to a predetermined delineated area of said first substrate material.

41. The kit of claim 23 wherein said means for protecting said art form is an acrylic spray.

42. The kit of claim 23 wherein said means for protecting said art form is shellac.

43. The kit of claim 22 further including an instruction booklet.

44. The kit of claim 22 including a plurality of sheets of said first substrate material, said plurality of sheets being of different predetermined colors.

45. The kit of claim 22 including a plurality of sheets of said second substrate material.

46. The kit of claim 26 including at least three paraffin material markers of each color.

47. The kit of claim 22 including a container of adhesive for securing or for affixing said first sheets to said second sheets.

* * * * *